US012203254B2

(12) United States Patent
Stadtler et al.

(10) Patent No.: US 12,203,254 B2
(45) **Date of Patent: *Jan. 21, 2025**

(54) METHOD FOR REMOVING A JET REGULATOR FROM A FIXTURE OUTLET, JET REGULATOR, USE OF A JET REGULATOR RECEIVING AREA, AND SET CONSISTING OF A JET REGULATOR AND A TOOL

(71) Applicant: Neoperl GmbH, Mullheim (DE)

(72) Inventors: Georg Stadtler, Mullheim (DE); David Birmelin, Mullheim (DE)

(73) Assignee: NEOPERL GMBH, Mullheim (DE)

( * ) Notice: Subject to any disclaimer, the term of this patent is extended or adjusted under 35 U.S.C. 154(b) by 726 days.

This patent is subject to a terminal disclaimer.

(21) Appl. No.: 17/427,148

(22) PCT Filed: Dec. 13, 2019

(86) PCT No.: PCT/EP2019/085017

§ 371 (c)(1),
(2) Date: Sep. 1, 2021

(87) PCT Pub. No.: WO2020/156726

PCT Pub. Date: Aug. 6, 2020

(65) Prior Publication Data

US 2022/0049480 A1 Feb. 17, 2022

(30) Foreign Application Priority Data

Feb. 1, 2019 (DE) ..... 202019100611.0

(51) Int. Cl.
*E03C 1/086* (2006.01)
*E03C 1/084* (2006.01)

(52) U.S. Cl.
CPC ..... *E03C 1/086* (2013.01); *E03C 1/084* (2013.01)

(58) Field of Classification Search
CPC ..... E03C 1/08; E03C 1/084; E03C 1/086
(Continued)

(56) References Cited

U.S. PATENT DOCUMENTS

2006/0226266 A1 10/2006 Russell et al.
2010/0102145 A1 4/2010 Staedtler
(Continued)

FOREIGN PATENT DOCUMENTS

DE 2552786 7/1976
DE 9317654 3/1994
(Continued)

*Primary Examiner* — Jason J Boeckmann
(74) *Attorney, Agent, or Firm* — Volpe Koenig

(57) ABSTRACT

A method for removing a jet regulator from a fixture outlet, a jet regulator and to a set consisting of a jet regulator and a tool are provided, wherein the jet regulator has a housing and a latching element mounted movably on the housing. The latching element is adjustable by a force transmission from a spring element, which is arranged inside a cutout of the housing and is accessible from outside the fixture outlet, to the latching element. The latching element, in its rest position, protrudes over the housing in order to hold the jet regulator in the fixture outlet. A tool for removal purposes is inserted in an insertion direction into the fixture outlet, and the spring element is acted upon with the tool during the insertion operation until the latching element releases the jet regulator.

19 Claims, 4 Drawing Sheets

(58) Field of Classification Search
USPC ..... 239/428.5, 589.1
See application file for complete search history.

(56) References Cited

U.S. PATENT DOCUMENTS

| | | | | |
|---|---|---|---|---|
| 2010/0127101 | A1* | 5/2010 | Stadtler ..... | E03C 1/086<br>239/600 |
| 2010/0213284 | A1 | 8/2010 | Staedtler | |

FOREIGN PATENT DOCUMENTS

| | | |
|---|---|---|
| DE | 202006008625 | 11/2007 |
| DE | 10200815869 | 10/2009 |
| DE | 202009002997 | 8/2010 |
| DE | 202015007873 | 7/2016 |
| FR | 717025 | 12/1931 |

* cited by examiner

METHOD FOR REMOVING A JET REGULATOR FROM A FIXTURE OUTLET, JET REGULATOR, USE OF A JET REGULATOR RECEIVING AREA, AND SET CONSISTING OF A JET REGULATOR AND A TOOL

TECHNICAL FIELD

The invention relates to a method for removing a jet regulator from a fixture outlet, wherein the jet regulator has a housing and a latching element arranged movably on the housing, wherein the latching element is acted upon by a spring element accessible from outside the fixture outlet and, in its rest position, protrudes over the housing in order to hold the jet regulator in the fixture outlet, wherein a tool for removal purposes is inserted in an insertion direction into the fixture outlet.

The invention also relates to a jet regulator, wherein the jet regulator has a housing and a latching element arranged movably on the housing, wherein the latching element is acted upon by a spring element accessible from outside the fixture outlet and, in its rest position, protrudes over the housing in order to hold the jet regulator in the fixture outlet, wherein a tool for removal purposes is inserted in an insertion direction into the fixture outlet. By insertion of the tool, for example, into a gap provided for it between fixture and jet regulator, said gap being formed, for example, by a cutout, forming a gap in the use position, on the jet regulator, the latching element can be disengaged.

Jet regulators of the type mentioned at the beginning are therefore not held in a fixture by a threaded connection between an outlet mouthpiece and the fixture outlet, but rather generally are fixed on the fixture exclusively by a latching mechanism formed by the latching and spring element. It is thus possible to dispense, for example, with an outlet mouthpiece protruding from the fixture, thus enabling a more esthetic overall appearance to be achieved.

Furthermore, the invention relates to a jet regulator with an outlet structure which has fins.

For example, the previously mentioned jet regulators can be rectangular jet regulators.

The invention furthermore relates to the use of a jet regulator receiving area of a fixture for closing a laterally open region of a jet regulator.

Finally, the invention relates to a set consisting of a jet regulator and a tool.

BACKGROUND

The removal of a jet regulator from a fixture by a method of the type mentioned at the beginning has previously had the disadvantage that, in an inserted position of the jet regulator, the latching element which is braced by the housing of the jet regulator can be brought only with difficulty from its rest position (in the use position this corresponds to a fixing position) into a removal position. For this purpose, a tool has to be inserted into a gap between fixture and jet regulator in such a manner that it reaches behind the spring element on the side thereof facing away from the housing in order to be able to move the spring element counter to the insertion direction by application of force in order to subsequently move same in the direction of the housing. Latching elements of the known type therefore generally lead to an axial fixing by support on an impingement surface of the fixture outlet, the impingement surface running transversely or perpendicularly to the insertion direction. This furthermore has the disadvantage that a buffer space has to be kept ready in the fixture outlet in order to be able to lift the latching element off the impingement surface in the insertion direction and subsequently to move same onto the housing. If, however, soiling occurs in the buffer space after prolonged use of the jet regulator, the removal can frequently be brought about only with extreme difficulty.

SUMMARY

The invention is therefore based on the object of providing a method and a jet regulator of the type mentioned at the beginning, in which the problems mentioned are removed by improving the use properties.

The object mentioned is achieved according to the invention by one or more of the features described herein. In particular, in order to achieve the object, first of all a method of the type mentioned at the beginning is proposed, in which the spring element is acted upon with the tool during the insertion operation until the latching element releases the jet regulator. A novel unlatching mechanism is thus formed in order to be able to more simply release a jet regulator held in a fixture outlet.

Advantageous refinements of the invention will be described below, said refinements by themselves, or in combination with the features of other refinements, are optionally being able to be combined together.

According to an advantageous refinement, it can be provided that the tool latches into an undercut, which is oriented in the insertion direction, on the jet regulator in order to be able to pull the jet regulator out of the fixture outlet. The latching enables a force to be transmitted to the jet regulator by the tool. In order to be able to achieve a force-fitting and/or form-fitting latching, the tool can have at least one projection, preferably at least two projections, which engage in the undercut(s) on the jet regulator in the use position.

A pulling mechanism can therefore be formed. In contrast to previously known solutions, it has therefore been succeeded for the first time by the invention to decouple an unlatching mechanism from a pulling mechanism. This considerably simplifies the pulling out of the jet regulator from the fixture outlet.

The at least one undercut can project into a gap-forming cutout, which is provided for the insertion of the tool, on the housing of the jet regulator. In particular, the undercut can protrude from the housing transversely or perpendicularly with respect to the insertion direction. The at least one projection can have a contact surface which is inclined in the direction of the jet regulator and which acts upon the at least one undercut during the insertion operation such that the projection is deflected before it latches downstream of the undercut in the insertion direction. The at least one projection can be arranged, for example, on a spring means of the tool.

The undercut itself can have a mating contact surface oriented in a corresponding manner, preferably parallel to the contact surface of the projection, in order to be able to push the mating contact surface against the contact surface upon insertion of the tool.

The abovementioned object is furthermore achieved according to the invention by one or more of the features described and claimed herein. In particular, in order to achieve the object, a jet regulator of the type mentioned at the beginning is proposed, wherein the spring element is configured and/or arranged in such a manner that it can be acted upon with a tool, which is inserted in an insertion direction into the fixture outlet, during the insertion operation until the latching element releases the jet regulator.

The spring element can be arranged, for example, in a cutout, for example the cutout already mentioned previously, on the housing, said cutout being provided for the insertion of the tool.

In order to be able to even further simplify the pulling of the jet regulator out of the fixture outlet, it can be provided that the spring element does not protrude over the housing in the rest position.

According to a further advantageous refinement, the spring element can have at least two interconnected legs, in particular interconnected at an apex point. By action upon the spring element by the tool, for example by two rigid arms of the tool, the two legs are moved toward each other or are moved away from each other until the latching element or the latching elements in each case connected to a leg no longer protrude over the housing. The two legs are preferably moved toward each other by the tool in a direction transversely or perpendicularly with respect to the insertion direction in order to move the latching element or the latching elements out of the rest position into the release position. The tool therefore, for example, presses the two legs of the spring element together in order to be able to remove the jet regulator.

The spring element is connected to the latching element or to the latching elements, with the latching element or the latching elements being moved at the same time as the spring element is adjusted.

The latching element or the latching elements of the jet regulator protrude over the housing in the rest position in a direction obliquely or perpendicularly with respect to the insertion direction. The at least one latching element thus forms a radial latching on the fixture outlet. The holding force exerted by the latching element (can correspond to the clamping force of the spring element) acts here perpendicularly or virtually perpendicularly to the inner wall of the fixture outlet.

A further independent solution is achieved by the features described herein. In particular, according to the invention, a jet regulator with an outlet structure which has fins is proposed, wherein the fins at least in one region of the outlet structure face outward in order to produce a diverging water flow. A particularly attractive outlet pattern can thus be produced. In particular, for example, in the case of a rectangular jet former, a virtually rectangular water jet can thus be produced.

According to an advantageous refinement, it can be provided that the previously mentioned region is arranged in an edge region of the outlet structure, and/or in that the region is arranged in a central region of the outlet structure.

With a further advantageous refinement of the jet regulator, it can be provided that the fins which face outward have a cross section which is oriented transversely with respect to their extent and which has an outer contour running in a curved manner. This has the advantage that a particularly good separation of individual water jets is possible, as a result of which a better jet shape can be achieved. For example, a better rectangular jet shape can be achieved in this way if a rectangular jet regulator is involved.

According to a further advantageous refinement, fins having a cross section which is oriented transversely with respect to their extent and which has an outer contour aligned in the flow direction can be arranged outside the previously mentioned region. Said fins can therefore extend in the flow direction. In particular, said fins outside the previously mentioned region can be formed straight and lead to a water jet flowing out rectilinearly.

According to a further independent solution which alternatively can also be considered in combination with the previously mentioned features, a jet regulator is proposed, in particular as previously described and claimed herein, with a jet acceleration unit which, on the outside, has a seal encircling around a flow direction and with respect to which on the outflow side jet forming elements, in particular fins, are arranged, which extend transversely with respect to the flow direction, wherein the jet forming elements each have a free end at which they protrude from a carrier wall running along the flow direction. This has the advantage that the jet regulator can be produced by injection molding methods. In particular, the jet regulator has the advantage that a housing part and a jet former part are formed integrally. In the case of previously known jet regulators with jet former parts for producing a diverging water flow, it has always been required that the jet former parts have been formed separately from the housing. A simpler manufacturing of a jet regulator with the desired properties is therefore now possible.

A further advantageous refinement can make provision for the jet acceleration unit to be formed at an inflow-side end of a jet aeration region. For example, the jet acceleration unit can be formed as a perforated plate or as a combination of a diffuser and a diffuser ring.

According to a development of the jet regulator, the latter can be characterized by an elongate, noncircular outer contour transversely with respect to the flow direction. In particular, the free ends of the jet forming elements can in each case be arranged on a long side of the outer contour in the use position. Alternatively or additionally, in the use position, the carrier wall can be arranged on a long side of the outer contour.

According to a further advantageous refinement, the free ends can form a laterally open region in a circumferential wall. In particular, the jet forming elements can end at a uniform height.

According to a further advantageous refinement, the latching element can be guided in a guide formed by the housing. In particular, the guide can be designed as a plain bearing and/or it can be determined by the guide that the latching element is adjustable, preferably is adjustable rectilinearly, in one, in particular only in one, degree of freedom.

In order to be able to more precisely determine the extent to which the latching element can be extended, it can be provided, according to a further advantageous refinement, that at least one stop is formed on the housing, said stop being acted upon by a mutually corresponding counter stop on the latching element in a latching position. In particular, the extent to which the latching element protrudes at maximum from the housing can be defined by the stop. Stop and counter stop therefore lie spaced apart from each other in a release position and/or are in contact in a latching position.

According to a further advantageous refinement, the latching element and/or the spring element can be formed separately from the housing. Therefore, the latching element and/or the spring element can be formed separately from the housing rather than as part of the housing. The jet regulator preferably can have two latching elements which are in each case connected to the spring element or to a respective spring element. A latching lug can be formed at a free end of the latching element, said latching lug being pulled back into a release position when the spring element is actuated. By a central actuation of the spring element, the latching element or the latching elements can therefore also be adjusted. The latching element and/or the spring element are thus not integrally formed on the housing and can therefore be adjusted relative to the housing.

The separate configuration of the latching element and/or of the spring element from the housing has the advantage that the latching lugs at the ends of the latching elements are adjustable simultaneously. Upon actuation of the spring element or of the spring elements, the latching lugs are therefore released simultaneously. The simultaneous adjustment of the latching lugs is also possible although they protrude from the housing on sides of the jet regulator facing away from one another. In other words, they lie far away from one another on sides of the jet regulator facing away from one another. Particularly good fixing of the jet regulator in the inserted state can thereby be achieved, with the release also being simplified by simple action upon the central spring element. By this configuration, the action upon the spring element therefore does not take place at the location of the latching, but rather spaced apart therefrom. Therefore, a space is not required for inserting the tool at the location of the latching.

The invention furthermore relates to the use of a jet regulator receiving area of a fixture for closing a laterally open region of a jet regulator, as is described and claimed herein, wherein the laterally open region is provided by the free ends of the jet forming elements and the jet regulator receiving area covers the laterally open region of the jet regulator inserted into the jet regulator receiving area.

Furthermore, the invention relates to a set consisting of a jet regulator, in particular as is described and claimed herein, and a tool, for carrying out a method, as is described and claimed herein.

BRIEF DESCRIPTION OF THE DRAWINGS

The invention will now be described in more detail with reference to exemplary embodiments, but is not restricted to said exemplary embodiments. Further exemplary embodiments emerge from the combination of the features of individual or a plurality of claims with one another and/or with individual features or a plurality of features of the exemplary embodiment.

In the figures.

DETAILED DESCRIPTION

Figure 1:
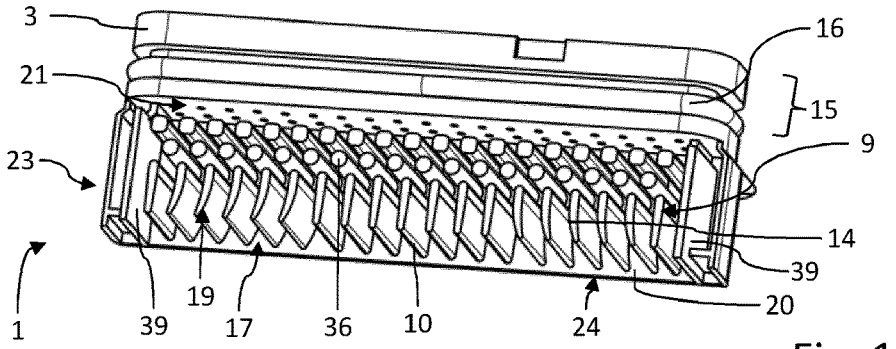
FIG. 1 shows a possible embodiment of a jet regulator according to the invention with a plurality of jet former elements in the form of fins, in a perspective illustration.
Figure 2:
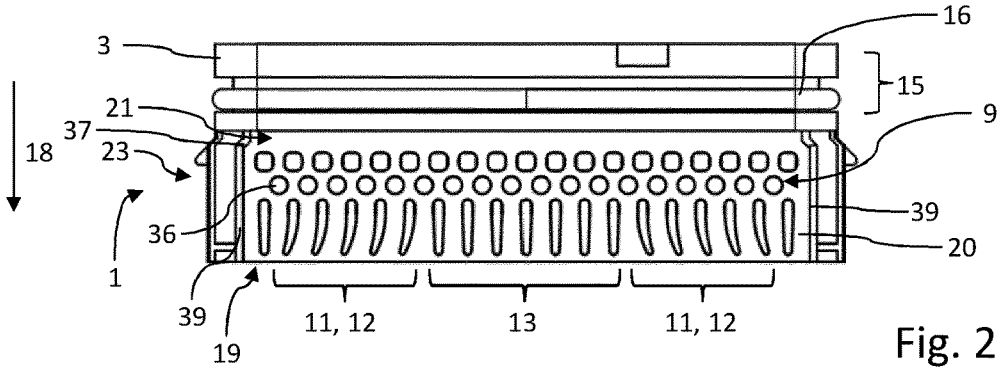
FIG. 2 shows the variant embodiment from FIG. 1 in a side view.
Figure 3:
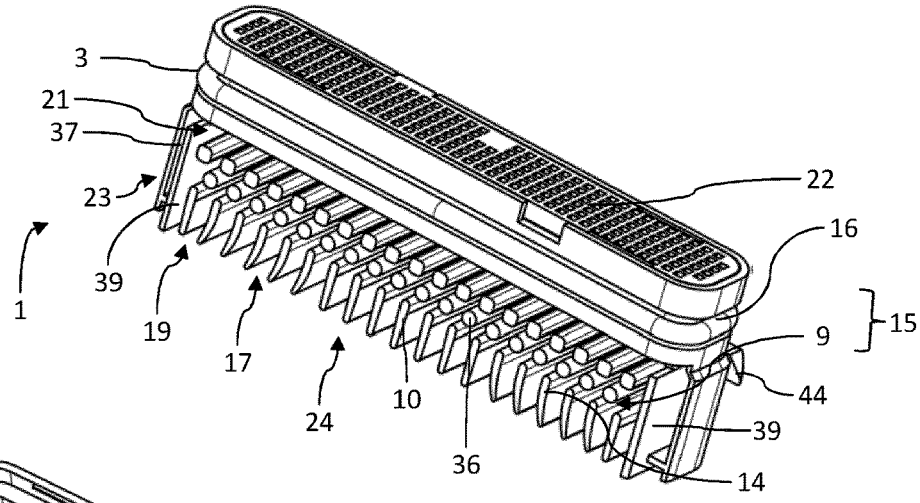
FIG. 3 shows a further perspective illustration of the previously mentioned jet regulator with an attached attachment screen.
Figure 4:
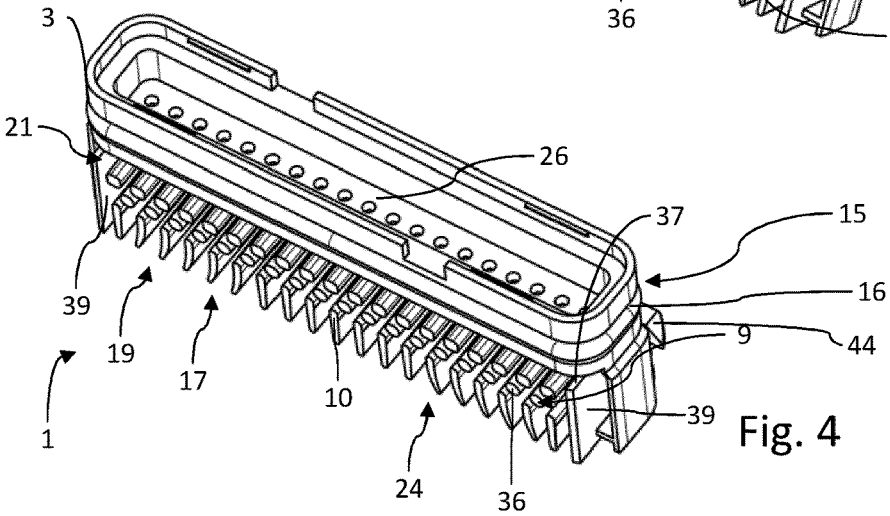
FIG. 4 shows a further perspective illustration of the previously mentioned jet regulator with the attachment screen removed.
Figure 5:
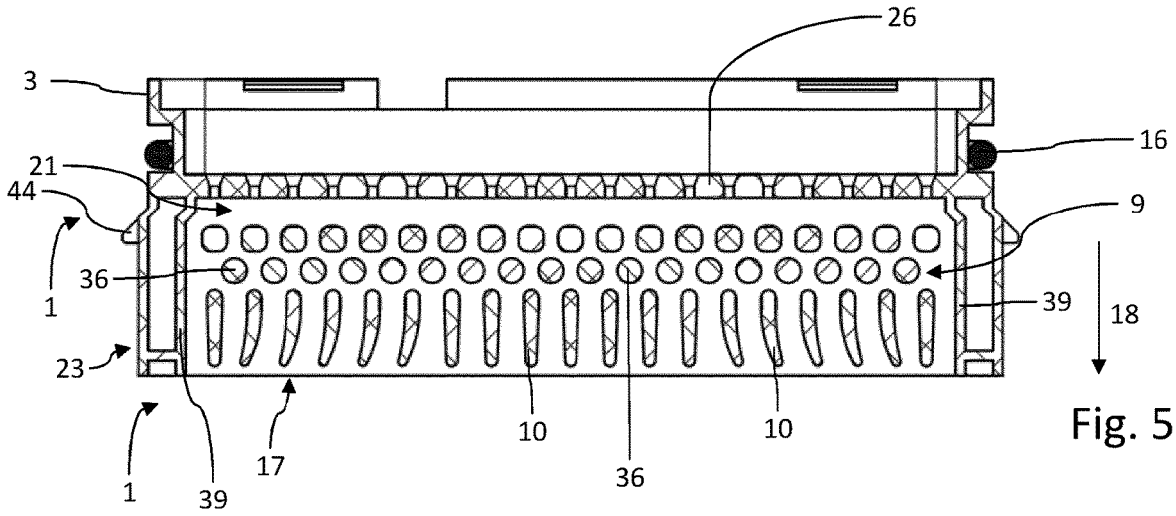
FIG. 5 shows a longitudinal section through an embodiment of the jet regulator, as emphasized in FIG. 6 by the arrows indicated by A.
Figure 6:
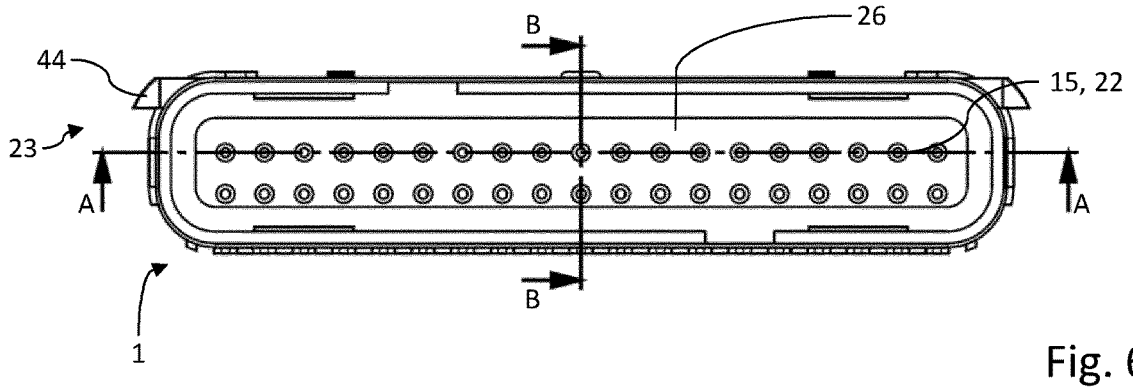
FIG. 6 shows a top view of the jet regulator with inserted section lines A and B.
Figure 7:
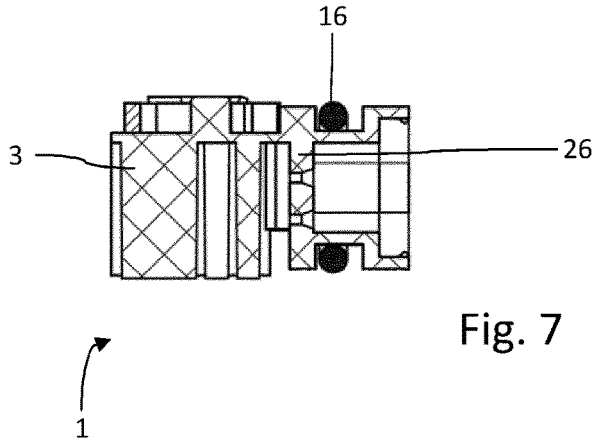
FIG. 7 shows a cross section through the embodiment of the jet regulator, as emphasized in FIG. 6 with the arrows indicated by B.

FIGS. 1-7 illustrate a plurality of views of a jet regulator denoted as a whole as 1.

The jet regulator 1 is configured to be inserted in the use position into a jet regulator receiving area 25 provided for it on a fixture outlet 2 and to be fixed therein.

FIGS. 1-7 each show a rectangular configuration of a jet regulator 1 which has a noncircular outer contour 23.

In order to be able to obtain a jet shape which is as rectangular as possible, the jet regulator 1 has a particular outlet structure 9. The outlet structure 9 comprises a multiplicity of jet forming elements 17 arranged spaced apart from one another.

The jet forming elements 17 comprise fins 10 which are arranged next to one another in at least one row on an outlet side of the jet regulator 1. The fins 10 form an outlet pattern of the overall jet of a fluid flowing through them. Since they are arranged in the flow path of the jet regulator 1, the overall jet washes around them.

The outlet structure 9 comprises a region 11 in which the fins 10 face outward in order to produce a diverging water flow. For example, the fins here can be bent outward and/or can be arranged obliquely in comparison to the flow direction 18. In the variant embodiment which is illustrated, said region 11 is formed in the edge regions 12. The fins 10 in the previously mentioned region 11 have, for example, a cross section 14 with an outer contour running in a curved manner. They therefore deflect the fluid flow.

By contrast, the fins 10 in the central region 13 are formed straight and form a straight fluid flow. This means that the fins 10 which are arranged outside the region 11 have a cross section which has an outer contour aligned in the flow direction. Furthermore, the two outermost fins 10 in the row of fins 10 are likewise formed straight.

The fins 10 each extend perpendicularly or transversely with respect to the flow direction 18. The jet forming elements 17 are formed on a carrier wall 20 of the housing 3. The jet forming elements 17 and the housing 3 are thus integral. The jet forming elements 17, in particular the fins 10, have a free end 19 via which said fins are not arranged on a carrier wall 20, but lie freely. The free ends 19 of the jet forming elements 17 and the carrier wall 20 each form a long side of the outer contour 23 of the jet regulator 1. The jet forming elements 17, in particular the fins 10, protrude transversely or perpendicularly from the carrier wall 20 into the flow path.

In the region of the free ends 19 of the jet forming elements 17, a circumferential wall of the housing 3 has an in particular laterally open region 24. The jet forming elements 17 have a uniform length or at least a majority of the jet forming elements 17 have a uniform length. They thus end at a uniform height.

A jet acceleration unit 15 is arranged upstream of the outlet structure 9 in the flow direction 18. The jet acceleration unit 15 is in turn mounted upstream of a jet aeration region 21 in the flow direction 18.

A liquid flowing through the jet regulator 1 therefore flows first of all through the passage openings of the jet acceleration unit 15, then through the jet aeration region 21, in which the liquid is mixed with air, before the jet is formed in the outlet structure 9 and leaves the jet regulator or the fixture outlet 2 on the outlet side.

The jet aeration region 21 is formed within the housing 3 in the flow path of the liquid. The jet aeration region 21 contains a plurality of jet forming elements 17 which, as illustrated in FIGS. 1 to 7, can be designed, for example, as distributor elements 36 in order to be able to achieve splitting of the water jet and better mixing thereof with air sucked in from the outside through at least one air duct 37. At least one air duct 37 is formed on the housing 3, the air duct penetrating at least one wall of the housing 3 in order to be able to suck in air from the outside into the jet aeration region 21 by the negative pressure arising here.

The at least one air duct 37 is preferably formed downstream of the seal 16 in the flow direction 18. The at least one air duct 37 can furthermore preferably be arranged on a narrow side of the housing 3.

The air duct 37 is at least partially formed by a boundary wall 39 which extends in the flow direction 18 and laterally bounds the flow path. The boundary wall 39 extends in the flow direction 18 over the entire region in which the jet aeration region 21 and/or the outlet structure 9 are/is arranged. The air duct 39 can therefore run between an outer wall of the housing 3 and the boundary wall 39. An outer end of the air duct 39 can lie, for example, on the outlet side of the jet regulator 1.

The jet regulator 1 preferably has at least two air ducts 37. The latter can be formed in particular on opposite sides, for example narrow sides of the housing 3.

The distributor elements 36—similarly to the previously described fins 10—can be formed integrally with the housing 3. A cross section of the distributor elements 36 can have, for example, rounded corners, in particular can be round. The rounded corners allow production of noise to be better avoided. However, other shapes are also possible. It is crucial here that the distributor elements 36 constitute a flow obstacle within the flow path, which can be achieved, for example, by the distributor elements 36 having an impact surface which runs in particular at least partially transversely with respect to the flow direction 18. The distributor elements 36 of the configuration shown are arranged in two rows, in each case arranged next to each other, wherein the distributor elements 36 of the first and second row are arranged offset from one another in order to be able to achieve as good a splitting as possible of a fluid flow and mixing with air.

The distributor elements 36 are formed on a or the already mentioned carrier wall 20 of the housing 3 and protrude, in particular transversely or perpendicularly, into the flow path. Furthermore, the distributor elements 36 also in each case have free ends 19 which form the open region 24 in the circumferential wall of the housing 3, in particular together with the fins 10. As is shown in FIGS. 1 to 7, the distributor elements 36 have a uniform height with the fins 10. The fins 10 are mounted on the downstream side of the distributor elements 36.

The laterally open region 24 extends over at least 10%, in particular at least 20%, in particular at least 25%, in particular at least 33%, in particular at least 50%, preferably at least 60%, preferably at least 65%, preferably at least 80%, preferably at least 90%, of a side of the jet regulator 1, in particular the longitudinal side of the jet regulator 1.

The jet regulator 1 has an encircling seal 16 on the outer side of the jet acceleration unit 15. It is possible by using the seal 16 to seal an outside transition of the jet acceleration unit 15 to the downstream outlet structure 9 in the use position by the seal 16 lying against the inside of the fixture outlet 2.

The jet regulator receiving area 25 of the fixture outlet 2 has a stepped design. This has the advantage that, when the jet regulator 1 is installed and removed, the seal 16 does not have to be pushed with friction over the entire length of the jet regulator receiving area 25. In the inserted state, the seal is pressed and compressed against the wall of the fixture outlet 2. It can be provided that the jet regulator receiving area 25 has a groove into which the seal 16 is inserted in the inserted state, wherein the seal 16 does not completely fill the groove, in order to permit better sealing.

The jet acceleration unit 15 can be designed, for example, as a perforated plate 26 and/or as a combination of a diffuser and a diffuser ring (not shown). The combination of a diffuser and a diffuser ring here in a manner known per se can have a diffuser acting as an impact plate, followed by an annular nozzle delimited by a rectangular diffuser ring.

In the use position of the jet regulator 1—i.e. in the state inserted in the fixture outlet 2 in a jet regulator receiving area 25 adapted to the jet regulator 1—the jet regulator receiving area 25 covers the laterally open region 24. The open region 24 is thus covered by an inner wall of the jet regulator receiving area 25. The covering does not result in complete sealing, but rather play is provided in order to permit certain tolerances. This has the advantage that the outlet structure 9 consisting of jet forming elements 17—such as, for example, of fins 10 and distributor elements 36—can be designed as a part which is integrally formed on the housing 3 and in particular is connected monolithically to the housing 3. The production can be undertaken, for example, by an injection molding method.

FIGS. 8 to 11 show a further variant embodiment of a jet regulator 1 as a set with a tool 6, which can be formed by itself or in combination with the features of the previously mentioned variant embodiment.

The jet regulator 1 has a latching element 4 which is guided movably on the housing 3 thereof and which can be acted upon by a spring element 5 accessible from outside the fixture outlet 2, and/or wherein a force transmission from the spring element 5 to the latching element 4 is possible. In the embodiment shown, the latching element 4 is connected to the spring element. In particular, the latching element 4 and the spring element 5 can be formed integrally, in particular monolithically.

In the rest position of the latching element 4 and/or of the spring element 5, the latching element 4 protrudes beyond an outer side of a wall of the housing 3. In the inserted state of the jet regulator 1, the rest position corresponds to the latching position in which the jet regulator 1 is held in the fixture outlet 2.

The spring element 5 has two legs 34 which are connected to each other in particular at an apex point. The two legs 34, in particular in the rest position, are spread in two opposite directions such that an angle is enclosed between the two legs 34. A force transmission from the spring element 5 to a respective latching element 4 is possible via the two remote ends of the two legs 34 of the spring element 5 since the remote ends are each connected to a latching element 4 and/or act upon the latter. In the present case, the latching elements 4 are connected to the spring element 5 at the remote ends of the spring element 5.

A novel unlatching mechanism 29 is thus created by the latching element 4 and the spring element 5. In the rest position, a force, in particular a clamping force produced by the spring element 5, acts on an inner wall of the fixture outlet 2 in the radial direction and/or perpendicularly or virtually perpendicularly by the latching element 4.

In order to remove the jet regulator 1 from the fixture outlet 2, a special tool 6 is required in order to permit unlatching. For this purpose, the tool 6 has to be inserted in an insertion direction 7 into the fixture outlet 2, wherein it thereby acts during the insertion operation upon the spring element 5, which is arranged outside the housing 3, until the latching element 4 releases the jet regulator 1.

Figure 8:
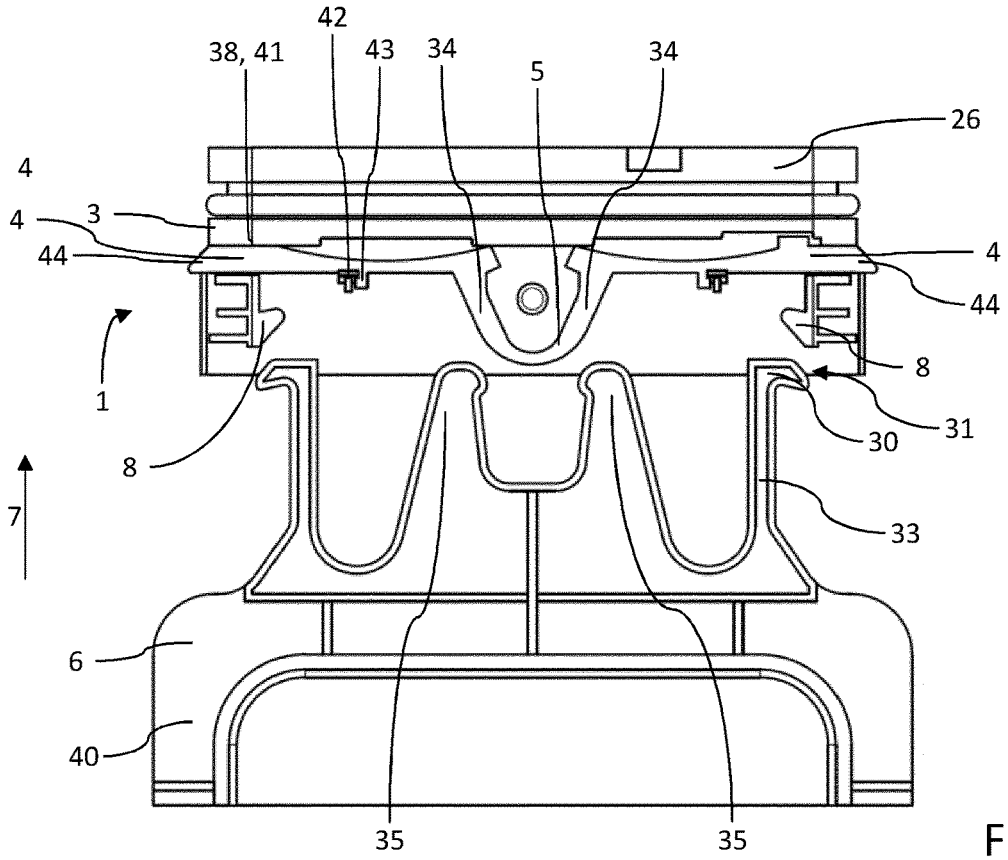
FIG. 8 shows a set consisting of a jet regulator and a tool, wherein the tool is not latched to the jet regulator (in a rear view)
Figure 9:
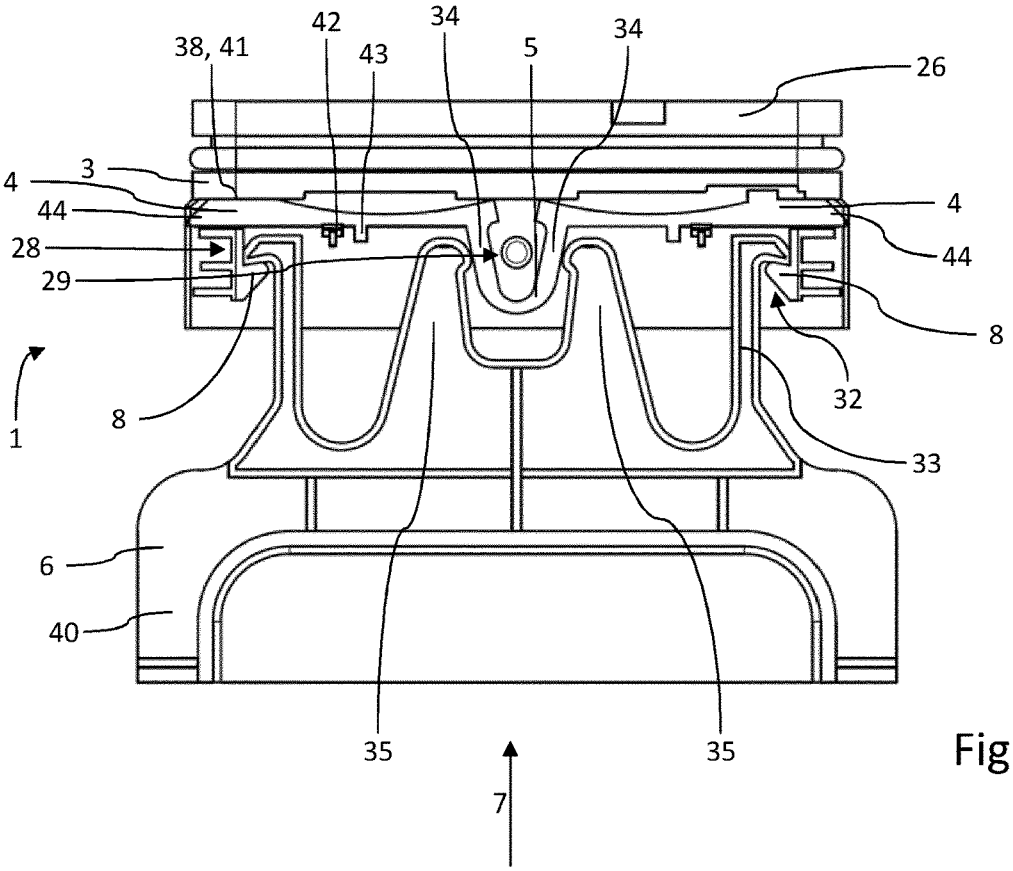
FIG. 9 shows the set from FIG. 8, wherein the tool is latched to the jet regulator (in a rear view)
Figure 10:
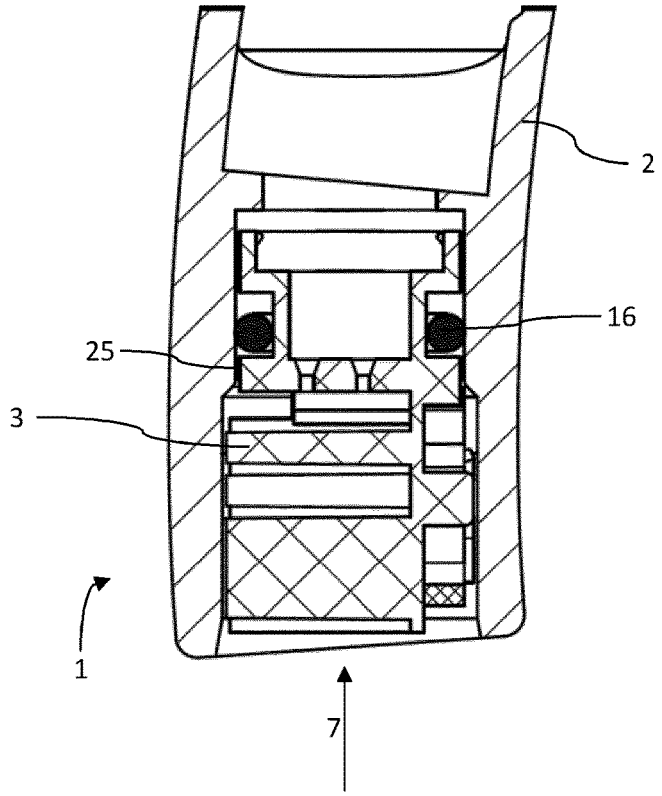
FIG. 10 shows an axially sectioned illustration of a jet regulator receiving area of a fixture outlet, into which a jet regulator is inserted (installation situation)
Figure 11:
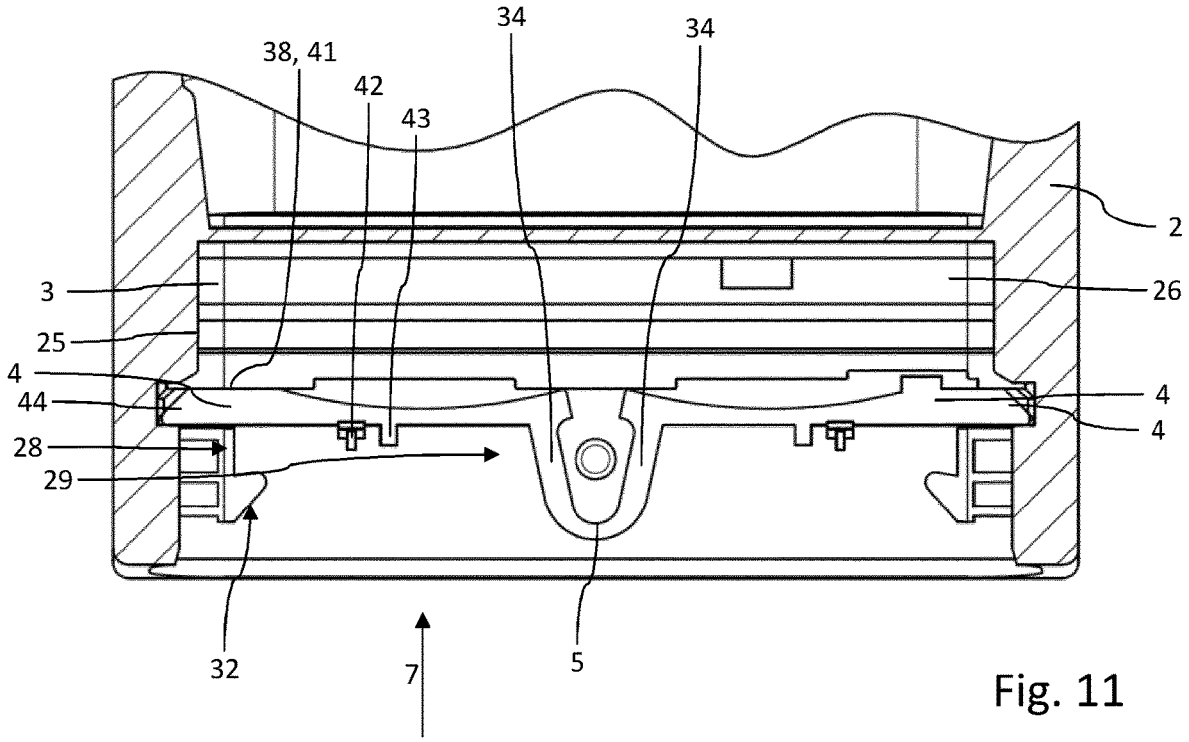
FIG. 11 shows a further axially sectioned illustration of a jet regulator receiving area of a fixture outlet, into which a jet regulator is inserted (installation situation), wherein the latching element acts perpendicularly on the inner wall of the jet regulator receiving area.

The tool 6 shown in FIGS. 8 and 9 has two rigid arms 35 which protrude from a basic body 40, which is in the form of a handle part. The rigid arms 35 are at a distance from each other that is smaller than a distance between the two remote ends of the legs 34. The insertion direction 7 can run along or parallel to a longitudinal axis and/or a central axis of the jet regulator 1.

During the insertion of the tool 6 into the fixture outlet 2, the two legs 34 are pressed together such that the distance between the spread ends of the two legs 34 is reduced. The latching elements 4 protruding beyond the housing 3 in the rest position are thereby pulled back so that the latching is released. The at least one latching element 4 is pulled back here in an, in particular rectilinear, direction running perpendicularly or transversely with respect to the insertion direction 7.

The at least one latching element 4 is mounted by a guide 41 which is formed on the housing 3 and can be designed, for example, as a plain bearing 38. Furthermore, latching elements 4 and spring element 5 are held on the housing 3 by the guide 41, in particular by the plain bearing 38. The latching element 4 is adjustable, preferably adjustable rectilinearly, in one degree of freedom by the guide 41.

Two stops 42 are formed on the housing 3 and two counter stops 43 corresponding thereto are formed on the latching element 4. In a latching position, a respective stop 42 and a counter stop 43 act on each other, with the extent to which the latching element 4 protrudes at maximum from the housing in the latching position thereby being defined. In the release position, the stops 42 and the counter stops 43 are not in contact with one another, but rather are in each case arranged spaced apart from one another.

Furthermore, the tool 6 has at least one projection 30, in particular two projections 30, which protrudes/protrude from a spring means 33 transversely with respect to the insertion direction 7. A contact surface 31 which is aligned obliquely with respect to the insertion direction 7 is formed on the upper side of the projection 30, with which upper side the latter is inserted first in the insertion direction 7.

The tool 6 is of flat design, and therefore it is insertable in particular on the rear side of the jet regulator 1. The spring elements 33 during the removal therefore do not have to be detached from undercuts or latching lugs 44.

An undercut 8 which is oriented in the insertion direction 7 and which protrudes transversely or perpendicularly to the insertion direction 7 is formed on the jet regulator 1, in particular on the housing 3 of the jet regulator 1.

The undercut furthermore has a mating contact surface 32 aligned obliquely with respect to the insertion direction 7 and/or at least approximately parallel to the contact surface 31 of the projection 30. When the tool 6 is inserted into the fixture outlet 2, the projection 30 is pushed and/or deflected counter to a restoring force, produced by the spring means 33, on the undercut 8 until the projection 30 snaps into the undercut 8 and the tool 6 is latched to the jet regulator 1.

A pulling mechanism 28 is thus formed which is decoupled from the previously described latching mechanism 29. However, decoupling of the jet regulator 1 from the fixture outlet 2 and coupling of the jet regulator 1 to the tool 6 is possible solely by insertion of the tool 6 into the fixture outlet 2, in particular exclusively in the insertion direction 7.

Coupling and unlatching thus take place virtually at the same time by the same movement. After the tool 6 is coupled to the jet regulator 1, a tensile force can be applied to the jet regulator 1 in order to be able to pull the released jet regulator 1 out of the fixture outlet 2 in the opposite direction to the insertion direction 7.

The jet regulator 1 can have one latching element 4 or a plurality of latching elements 4 which are connected to one spring element 5 or in each case to a spring element 5. However, it is advantageous if a plurality of latching elements 4 are connected to a common spring element 5 or if the latching elements 4 are in each case connected to a spring element 5 and the two spring elements 5 in turn are connected to each other.

In the shown variant embodiment of the jet regulator 1, the latching element 4 and/or the spring element 5 are/is formed separately from the housing 3. The latching element 4 and/or the spring element 5 are/is therefore formed separately from the housing 3 rather than as part of same. The jet regulator 1 can preferably have two latching elements 4 which are connected in each case to the spring element 5 or to a respective spring element 5. A respective latching lug 44 is formed at the free ends of the latching elements 4, said latching lugs being pulled back simultaneously into a release position when the spring element 5 is actuated. By a central actuation of the spring element 5, the latching element 4 or the latching elements 4 can therefore also be adjusted. The latching element 4 and/or the spring element 5 are therefore not integrally formed on the housing 3 and can therefore be adjusted relative to the housing 3.

The separate configuration of the latching element 4 and/or of the spring element 5 from the housing 3 has the advantage that the latching lugs 44 at the ends of the latching elements 4 are adjustable simultaneously. Upon actuation of the spring element 5 or of the spring elements 5, the latching lugs 44 are thus detached simultaneously. The simultaneous adjustment of the latching lugs 44 is also possible although the latter protrude out of the housing 3 on sides of the jet regulator 1 facing away from each other. The detaching takes place by simple action upon the central spring element 5. By this configuration, the action upon the spring element 5 therefore does not take place at the location of the latching, but rather spaced apart therefrom. A space is therefore not required for inserting the tool at the location of the latching.

The invention therefore relates in particular to a method for removing a jet regulator 1 from a fixture outlet 2, to a jet regulator 1 and to a set consisting of a jet regulator 1 and a tool 6, wherein the jet regulator 1 has a housing 3 and a latching element 4 mounted movably on the housing 3, wherein the latching element 4 is adjustable by force transmission from a spring element 5, which is arranged within a cutout of the housing 3 and is accessible from outside the fixture outlet 2, to the latching element 4, wherein the latching element 4, in its rest position, protrudes over the housing 3 in order to hold the jet regulator 1 in the fixture outlet 2, wherein a tool 6 for removal purposes is inserted in an insertion direction 7 into the fixture outlet 2, wherein the spring element 5 is acted upon with the tool 6 during the insertion operation until the latching element 4 releases the jet regulator 1.

LIST OF REFERENCE SIGNS

1 Jet regulator
2 Fixture outlet
3 Housing
4 Latching element
5 Spring element
6 Tool
7 Insertion direction
8 Undercut
9 Outlet structure
10 Fins
11 Region of the outwardly facing fins
12 Edge region
13 Central region
14 Cross section
15 Jet acceleration unit
16 Seal
17 Jet forming element
18 Flow direction
19 Free end
20 Carrier wall
21 Jet aeration region
22 Attachment screen
23 Outer contour
24 Laterally open region
25 Jet regulator receiving area
26 Perforated plate
28 Pulling mechanism
29 Unlatching mechanism
30 Projection
31 Contact surface
32 Mating contact surface
33 Spring means
34 Leg
35 Rigid arms
36 Distributor element
37 Air duct
38 Plain bearing
39 Boundary wall
40 Basic body
41 Guide
42 Stop
43 Counter stop
44 Latching lug

The invention claimed is:

1. A method for removing a jet regulator (1) from a fixture outlet (2), the method comprising:

providing the jet regulator (1) which has a housing (3) and a latching element (4) arranged movably on the housing (3), wherein the latching element (4) is acted upon by a spring element (5) accessible from outside the fixture outlet (2) and, in a rest position, protrudes over the housing (3) in order to hold the jet regulator (1) in the fixture outlet (2);

for removal, inserting a tool (6) in an insertion direction (7) into the fixture outlet (2); and acting upon the spring element (5) with the tool (6) during the inserting of the tool (6) into the fixture outlet (2) until the latching element (4) releases the jet regulator (1), wherein the spring element (5) comprises two legs (34) which are connected to each other at an apex point, in the rest position the two legs (34) are spread in two opposite directions such that an angle is enclosed between the two legs (34), and the latching element (4) is acted upon by two remote ends of the two legs (34), and wherein the tool (6) comprises a basic body (40) and two rigid arms (35) that protrude from the basic body (40), the two rigid arms (35) are formed at a distance from each other that is smaller than a distance between the two remote ends of the two legs (34) of the spring element (5), and, during the inserting of the tool (6) into the fixture outlet (2), the two legs (34) are pressed together by the two rigid arms (35) such that the distance between the two remote ends of the two legs (34) is reduced.

2. The method as claimed in claim 1, further comprising latching the tool (6) into an undercut (8), which is oriented in the insertion direction (7), on the jet regulator (1), and pulling the jet regulator (1) out of the fixture outlet (2) with the tool.

3. A jet regulator (1), comprising:

a housing (3);

a latching element (4) arranged movably on the housing (3), the latching element (4) is acted upon by a spring element (5) accessible from outside a fixture outlet (2) and, in a rest position, protrudes over the housing (3) in order to hold the jet regulator (1) in the fixture outlet (2), wherein a tool (6) for removal purposes is adapted to be inserted in an insertion direction (7) into the fixture outlet (2); and the spring element (5) is at least one of configured or arranged to be acted upon with the tool (6) during an insertion operation until the latching element (4) releases the jet regulator (1), wherein the spring element (5) comprises two legs (34) which are connected to each other at an apex point, in the rest position the two legs (34) are spread in two opposite directions such that an angle is enclosed between the two legs (34), and the latching element (4) is acted upon by two remote ends of the two legs (34), and wherein the tool (6) comprises a basic body (40) and two rigid arms (35) that protrude from the basic body (40), the two rigid arms (35) are formed at a distance from each other that is smaller than a distance between the two remote ends of the two legs (34) of the spring element (5), and, during the insertion of the tool (6) into the fixture outlet (2), the two legs (34) are pressed together by the two rigid arms (35) such that the distance between the two remote ends of the two legs (34) is reduced.

4. The jet regulator (1) as claimed in claim 3, further comprising an outlet structure (9) which has fins (10), and the fins (10) at least in one region (11) of the outlet structure (9) face outward in order to produce a diverging water flow.

5. The jet regulator (1) as claimed in claim 4, wherein the at least one region (11) is arranged in at least one of an edge region (12) of the outlet structure (9) or is arranged in a central region (13) of the outlet structure (9).

6. The jet regulator (1) as claimed in claim 4, wherein the fins (10) which face outward have a cross section (14) which is oriented transversely with respect to an extent thereof and have an outer contour that extends in a curved manner.

7. The jet regulator (1) as claimed in claim 4, wherein the fins (10) arranged outside of the at least one region (11) have a cross section (14) which is oriented transversely with respect to an extent thereof and have an outer contour aligned in a flow direction (18).

8. The jet regulator (1) as claimed in claim 4, further comprising a jet acceleration unit (15) which, on an outside thereof, has a seal (16) encircling around a flow direction (18) and with respect to which on an outflow side, jet forming elements (17) are arranged which extend transversely with respect to the flow direction (18), and the jet forming elements (17) each have a free end (19) at which they protrude from a carrier wall (20) extending along the flow direction (18).

9. The jet regulator (1) as claimed in claim 8, wherein the jet acceleration unit (15) is formed at an inflow-side end of a jet aeration region (21).

10. The jet regulator (1) as claimed in claim 8, further comprising an elongate, noncircular outer contour that extends transversely with respect to the flow direction (18), and at least one of the free ends (19) of the jet forming elements (17) or the carrier wall (20) are in each case arranged on a long side of the outer contour.

11. The jet regulator (1) as claimed in claim 8, wherein the free ends (19) form a laterally open region (24) in a circumferential wall.

12. The jet regulator (1) as claimed in claim 3, wherein the latching element (4) is guided in a guide (41) formed by the housing (3), and the guide (41) comprises a plain bearing (38), and the latching element (4) is adjustable by the guide (41) in one degree of freedom.

13. The jet regulator (1) as claimed in claim 3, further comprising at least one stop (42) formed on the housing (3), said stop being acted upon by a mutually corresponding counter stop (43) on the latching element (4) in a latching position.

14. The jet regulator (1) as claimed in claim 3, wherein at least one of the latching element (4) or the spring element (5) is formed separately from the housing (3).

15. A sanitary fixture arrangement comprising the jet regulator as claimed in claim 8 and a fixture with a jet regulator receiving area (25) for closing a laterally open region (24) of the jet regulator (1), and the laterally open region (24) is provided by the free ends (19) of the jet forming elements (17) and the jet regulator receiving area (25) covers the laterally open region (24) of the jet regulator (1) inserted into the jet regulator receiving area (25).

16. A set consisting of the jet regulator (1) as claimed in claim 3 and the tool (6), wherein the tool (6) is configured for removal of the jet regulator by insertion in an insertion direction (7) into a fixture outlet (2), that during an insertion operation acts upon the spring element (5) until the latching element (4) releases the jet regulator (1).

17. The jet regulator as claimed in claim 9, wherein the jet acceleration unit (15) is formed as at least one of a perforated plate (26) or a combination of a diffuser and a diffuser ring.

18. The jet regulator as claimed in claim 11, wherein the jet forming elements (17) end at a uniform height.

19. The jet regulator as claimed in claim 13, wherein an extent to which the latching element (4) protrudes at maximum from the housing (3) is defined by the stop (42).

* * * * *